US006659543B2

(12) United States Patent
McCutcheon et al.

(10) Patent No.: US 6,659,543 B2
(45) Date of Patent: Dec. 9, 2003

(54) CONVERTIBLE BENCH AND TABLE ASSEMBLY

(75) Inventors: Michel McCutcheon, Thetford Mines (CA); Michaël Molinger, Eastman (CA)

(73) Assignee: 9110-3309 Quebec Inc., Thetford Mines (CA)

( * ) Notice: Subject to any disclaimer, the term of this patent is extended or adjusted under 35 U.S.C. 154(b) by 0 days.

(21) Appl. No.: 10/124,403

(22) Filed: Apr. 18, 2002

(65) Prior Publication Data

US 2003/0197402 A1 Oct. 23, 2003

(51) Int. Cl.[7] ..... A47B 85/04
(52) U.S. Cl. ..... 297/127
(58) Field of Search ..... 297/124, 118, 297/125, 127, 119; 40/320

(56) References Cited

U.S. PATENT DOCUMENTS 342,847 A * 6/1886 Schleier
1,639,085 A * 8/1927 Fohey
1,678,691 A * 7/1928 De La Cuesta et al.
2,758,633 A * 8/1956 Apple
2,900,009 A * 8/1959 Haynes
5,292,172 A 3/1994 Watts et al.
5,718,475 A * 2/1998 Watts
6,189,965 B1 2/2001 Hecht et al.
6,241,312 B1 6/2001 Watts et al.

* cited by examiner

*Primary Examiner*—Milton Nelson, Jr.
(74) *Attorney, Agent, or Firm*—Ogilvy Renault; Robert Mitchell

(57) ABSTRACT

A convertible bench comprises a seat, a backrest and a pair of armrests extending between the seat and the backrest. Each armrest has a first end portion extending from the backrest and a second opposed end portion pivotally mounted to the seat for allowing the backrest to be swung about the armrests between a backrest position and a tabletop position. A stopper cooperates with the second end portion of each armrest for supporting the backrest in the backrest and tabletop positions thereof.

18 Claims, 4 Drawing Sheets

CONVERTIBLE BENCH AND TABLE ASSEMBLY

BACKGROUND OF THE INVENTION

1. Field of the Invention

The present invention relates generally to furniture and, more particularly, to a bench having a backrest that may be positioned to either serve as a backrest or as a tabletop.

2. Description of the Prior Art

Over the years various convertible benches have been developed. For instance, U.S. Pat. Nos. 5,292,172 and 6,241,312 both issued to Watts et al. on Mar. 8, 1994 and Jun. 5, 2001 respectively, disclose a convertible bench/table apparatus having a backrest pivotable between a backrest configuration and a tabletop configuration. The apparatus further includes a seat and a pair of armrests. The backrest is supported in its backrest and tabletop positions by abutting a surface of the armrests against the top surface of the seat. Although such an arresting structure is efficient, it represents a risk of personal injuries in that the operator may drop the armrests on his/her fingers when pivoting the backrest between its backrest and tabletop positions.

SUMMARY OF THE INVENTION

It is therefore an aim of the present invention to provide a convertible bench that is adapted to minimize the risk of injury while the backrest of the bench is being positioned to either serve as a backrest or as a tabletop.

It is also an aim of the present invention to provide a convertible bench that is easily and quickly convertible between a bench configuration and a table configuration.

Therefore, in accordance with the present invention, there is provided a convertible bench comprising a seat, a backrest supported by a pair of armrests articulated to the seat for allowing the backrest to be pivoted between a backrest position and a tabletop position, wherein each of the armrests is articulated to the seat via a pivot, and a stopper integrated to the pivot for providing structural support to the backrest in its backrest and tabletop positions.

In accordance with a further embodiment of the present invention, there is provided a convertible bench comprising a seat, a backrest, a pair of armrests extending between the seat and the backrest, each armrest having a first end portion extending from the backrest and a second opposed end portion pivotally mounted to the seat for allowing the backrest to be swung about the armrests between a backrest position and a tabletop position, and a stopper cooperating with the second end portion of each armrest for supporting the backrest in a selected one of the backrest and tabletop positions thereof.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
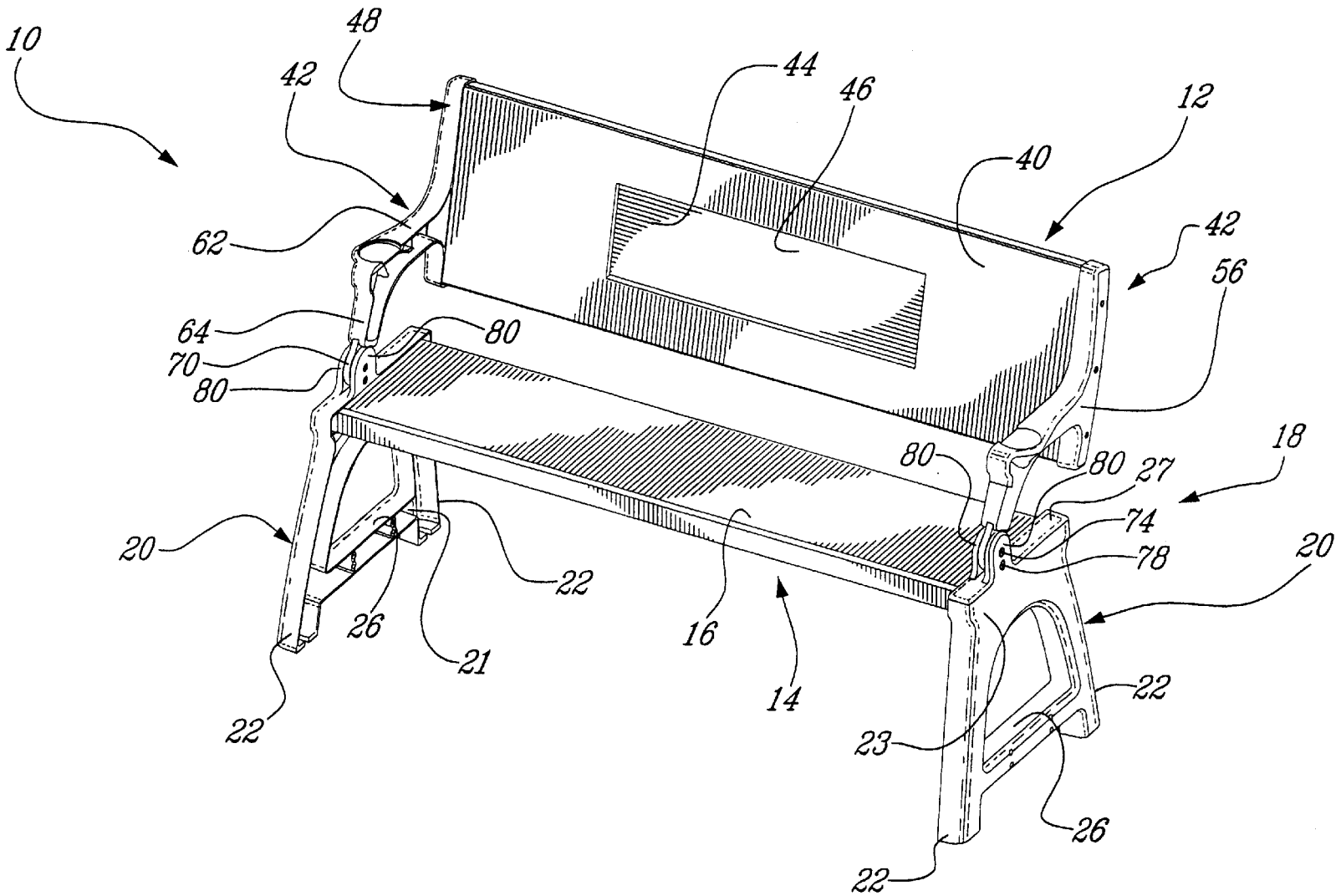
FIG. 1 is a perspective view of a convertible bench shown in a bench configuration in accordance with a preferred embodiment of the present invention.

Now referring to the drawings, and in particular to FIG. 1, a convertible park type bench embodying the elements of the present invention and generally designated by numeral 10 will be described.

Figure 2:
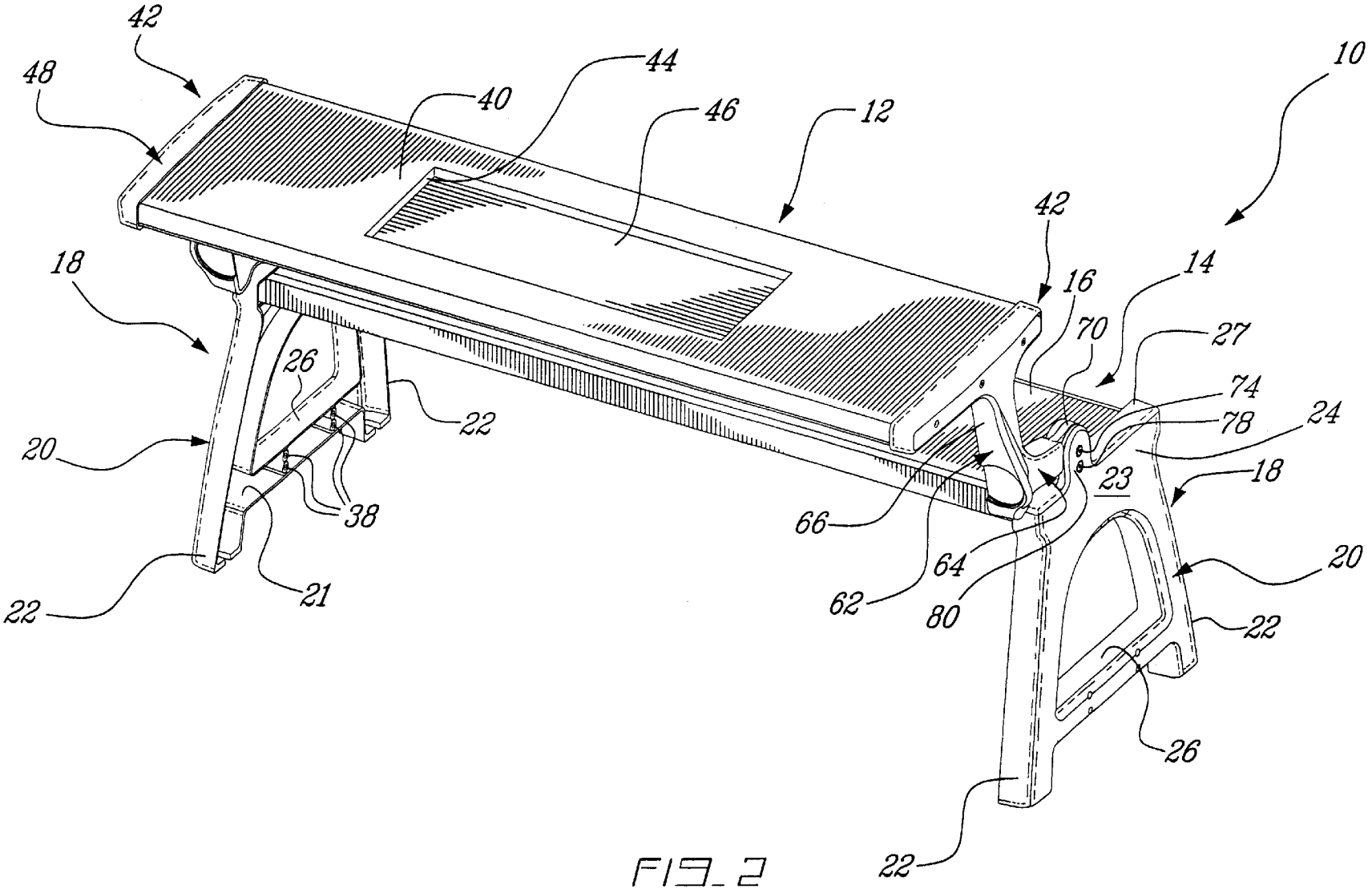
FIG. 2 is a perspective view of the convertible bench shown in a picnic table configuration.

As will be seen hereinafter, the convertible bench 10 comprises a backrest 12 that can be positioned to either serve as a backrest (FIG. 1) or as a tabletop (FIG. 2).

Figure 4:
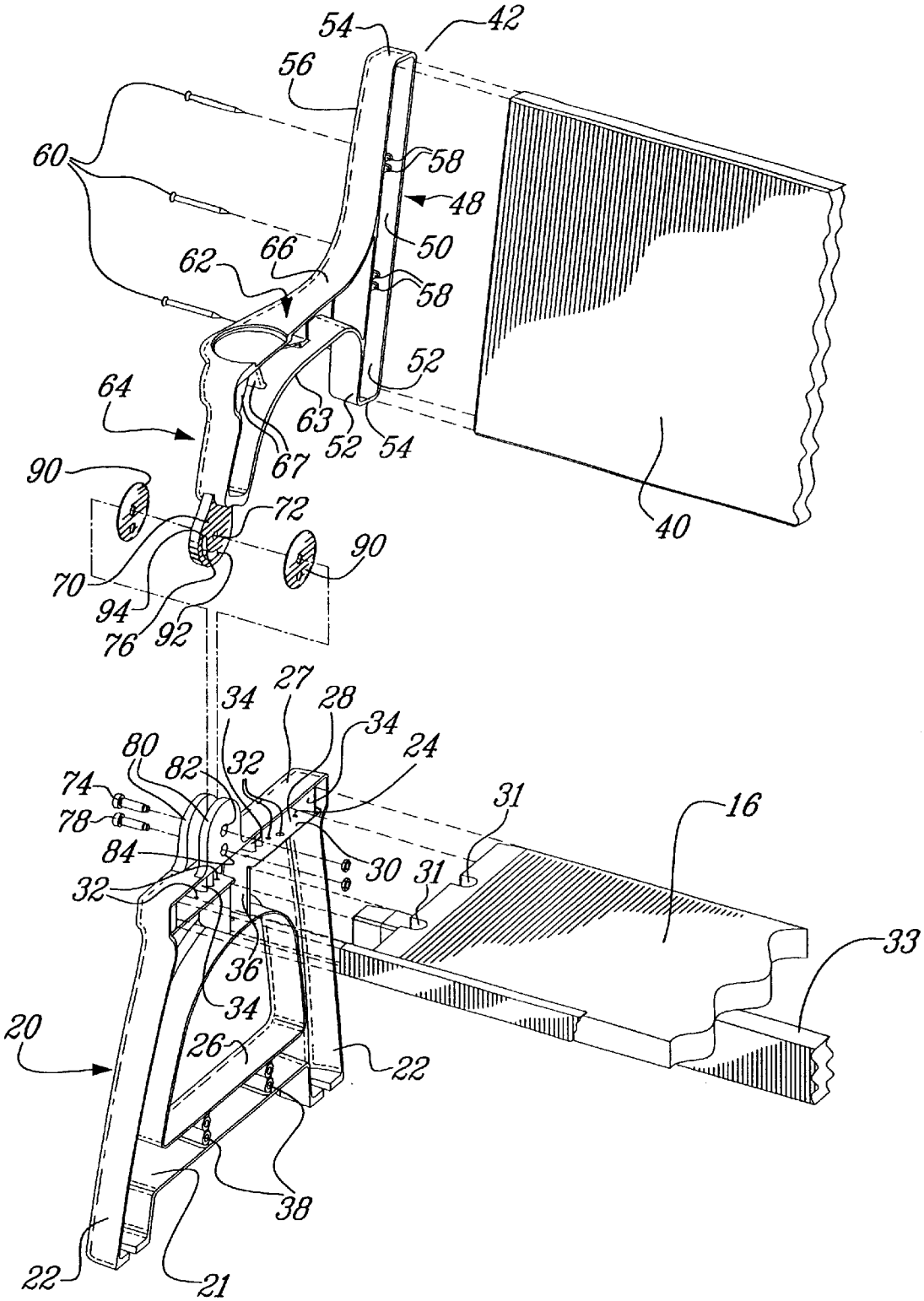
FIG. 4 is an exploded view of one end portion of the convertible bench shown in FIG. 1.

The convertible bench 10 further includes a seat 14 comprising a seat board 16 supported on a support frame 18. The support frame 18 includes a pair of side frame members 20 adapted to receive therebetween the seat board 16. 00015 Each side frame member 20 has an inner mounting surface 21 and a relatively smooth outer surface 23. As best seen in FIG. 4, each side frame member 20 includes a pair of legs 22 extending integrally downwardly from opposed ends of a seat mount 24. A C-shaped brace 26 extends between the lower end portions of the legs 22 to increase the structural rigidity thereof. The seat mount 24 has a top surface 27 and a bottom surface 28 defining therebetween a compartment 30 open on the inner side of the frame member 20 for receiving one end portion of the seat board 16. Holes 32 are defined in the bottom surface 28 of the seat mount 24 for receiving screws (not shown) in order to secure the seat board 16 in the compartment 30. Stiffening walls 34 extend from the outer surface 23 between the top surface 27 and the bottom surface 28 for engagement in corresponding grooves 31 defined in the adjacent end face of the seat board 16. A beam-receiving cavity 36 is defined centrally of each side frame member 22 underneath the compartment 30 thereof for captively receiving one end of a reinforcing beam 33. Hollow cylinders 38 extend from the outer surface 23 in the C-shaped brace 26 for receiving fasteners (not shown) in order to secure a bottom horizontal reinforcing member (not shown) between the side frame members 20.

The backrest 12 includes a backrest board 40 extending between a pair of armrests 42 pivotally mounted to the support frame 18. The armrests 42 are supported at one end only in a cantilevered fashion. As shown in FIGS. 1 and 2, a recess 44 can be defined in each side of the backrest board 40 to removably receive interchangeable advertising panels 46.

As shown in FIG. 4, each armrest 42 has a backrest-mounting portion 48 defining a longitudinal compartment 50 for captively receiving one end of the backrest board 40. The compartment 50 is circumscribed by a pair of sidewalls 52 and a pair of end walls 54 extending integrally from an outer facing side surface 56 of the armrest 42. Stiffening members 58 extend between the sidewalls 52 to reinforce the backrest-mounting portion 48. The stiffening members 58 are received in corresponding grooves (not shown) defined at the ends of the backrest board 40. Holes (not shown) are defined through the outer facing side surface 56 of each armrest 42 for receiving screws 60 or the like in order to secure the backrest board 40 to the associated armrest 42. Each armrest 42 further includes a forward arm portion 62 extending integrally forwardly from the backrest mounting portion 48 and an angled arm portion 64 depending at an angle from the forward arm portion 62. The forward arm portion 62 and the angled arm portion 64 are integral to one another and to the backrest-mounting portion 48. The forward arm portion 62 and the angled arm portion 64 are bounded by a top wall 66 and a bottom wall 68 extending integrally from the outer facing side surface 56 of the armrest 42. The forward arm portion 62 and the angled arm portion 64 are preferably open on an inner facing side of the armrest 42. Various stiffening members 67 extend from the outer side-facing surface 56 between the top and bottom walls 66 and 68 for increasing the structural integrity of the armrest 42. The forward arm portion 62 extends generally at right angles from the backrest-mounting portion 48.

The angled arm portion 64 terminates in a flattened disc end portion 70 having a central through bore 72 for receiving a pivot pin 74 and a curved slot 76 extending about the central through bore 72 along an arc of circle centered relative to the through bore 72 for receiving a stop pin 78.

As shown in FIGS. 1 to 4, a pair of spaced-apart parallel ears 80 extends integrally upwardly from a forward half portion of the top surface 26 of each side frame member 20 for receiving therebetween the flattened disc end portion 70 of the associated armrest 42. As shown in FIG. 4, two sets of registering holes 82 and 84 are defined in each pair of ears 80 for respectively receiving the pivot pin 74 and the stop pin 78. Each armrest 42 is pivotally mounted to its associated side frame member 20 by simply placing the flatted disc end portion 70 thereof between the ears 80 of the associated side frame member 20 so that the through bore 72 be in registry with the holes 82 and the curved slot 76 aligned with the holes 84. Once properly positioned, the pivot pin 74 and the stop pin 78 are respectively inserted through the holes 82 and the central through hole 72, and the holes 84 and the curved slot 76. The pivot pin 74 and the stop pin 78 are then secured in position by means of nuts or the like. Disposable wear discs 90 can be provided on either sides of the flattened disc end portion 70 to prevent premature wear thereof.

As opposed to known convertible benches wherein the movement of the armrests is limited by the abutment of the armrest against the top surface of the seat mount, the pivotal movement of the armrest 42 relative to its associated side frame member 20 is limited by the stop pin 74 in the slot 76. Since access to the slot 76 is prevented by the eats 80, a user cannot pinches his fingers while pivoting the backrest 12 between a backrest position (FIG. 1) and a tabletop position (FIG. 2). By so integrating a stopper in the pivot itself, the risk of injury during the conversion process of the bench 10 into a table is greatly minimized. It is understood that the stopper is not limited to a stop pin engaged in a slot enclosed in a housing. For instance, a protrusion extending from the top surface 26 of the side frame member 20 between the ears 80 for engagement in a peripheral groove or recess defined in the flatted disc end portion 70 could be used as well. Any stopper enclosed in a housing could in fact be used.

Figure 3:
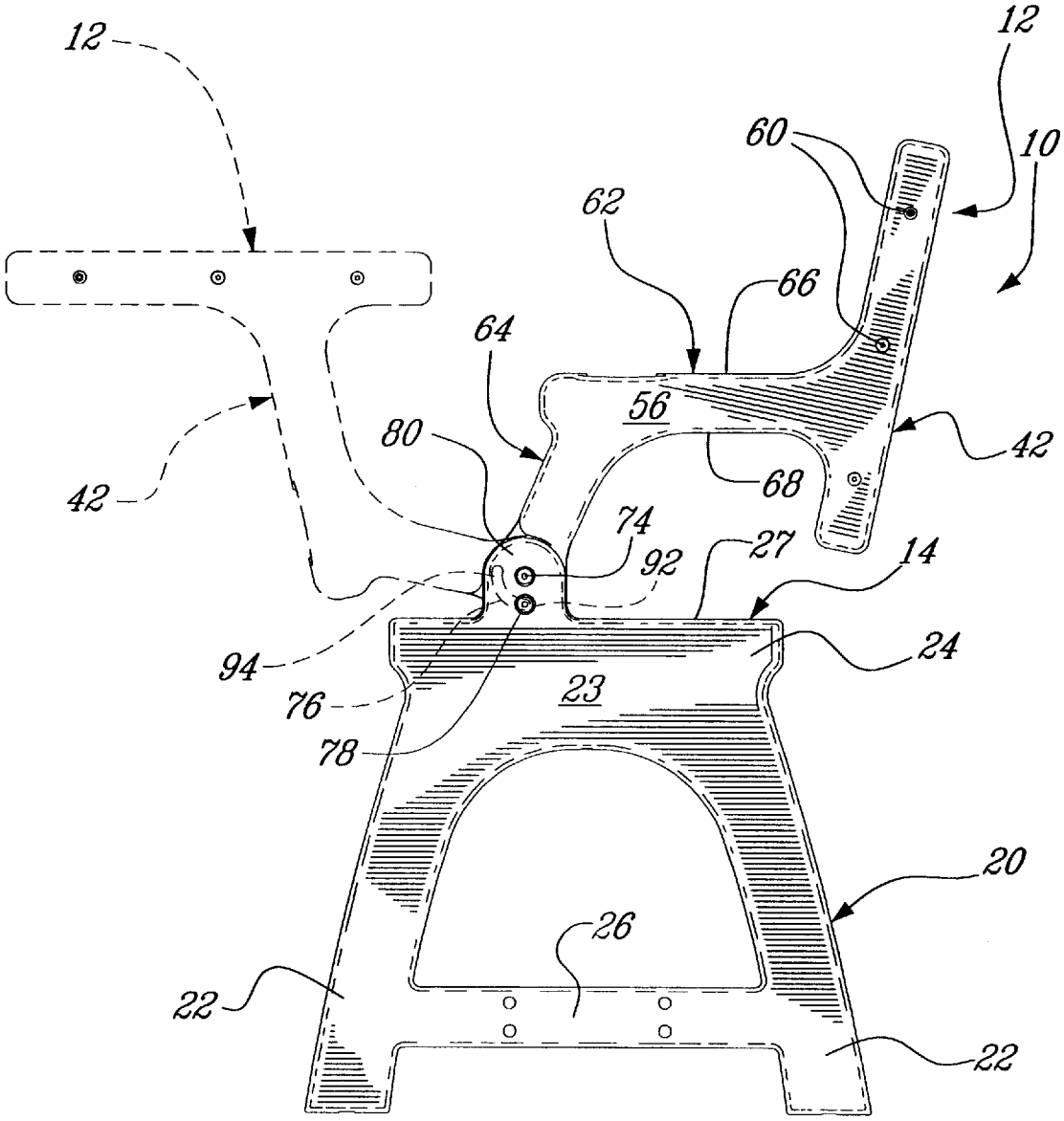
FIG. 3 is side elevation view of the convertible bench.

As shown in FIG. 3, the park bench 10 can be readily converted into a picnic table (FIG. 2) by simply pivoting the armrests 42 thereof in a forward direction until the stop pin 74 engages the closed end 92 of the slot 76. To convert the table back into a bench configuration, the user simply pivots the backrest 12 about the armrests 20 in the opposite direction until the stop pin 74 engages the opposed closed end 94 of the slot 76.

According to a preferred embodiment of the present invention, each side frame member 20 is formed as one integral piece, and each armrest 42 is formed as one integral piece. The side frame members 20 and the armrests 42 can be molded from various moldable materials, such as plastic, metal (e.g. aluminum), vinyl, or any other suitable material.

What is claimed is:

1. A convertible bench comprising a seat, a backrest supported by a pair of armrests articulated to the seat for allowing said backrest to be pivoted between a backrest position and a tabletop position, wherein each of said armrests is articulated to said seat via a pivot, and a stopper integrated to said pivot for providing structural support to said backrest in said backrest and tabletop positions thereof; wherein said pivot comprises a female portion and a male portion in received in said female portion, and wherein said stopper is received in a slot defined in said male portion.

2. A convertible bench as defined in claim 1, wherein said pivot includes a support structure, and wherein said stopper includes a stop pin held in a stationary position internally of said support structure.

3. A convertible bench as defined in claim 1, wherein each of said armrests has an end portion received between a pair of armrest mounting portions extending from said seat, said end portion defining a through borc for receiving a pivot pin mounted to said armrest mounting portion.

4. A convertible bench as defined in claim 3, wherein said stopper is provided between said armrest mounting portions and is received in a stopper receiving portion defined in said end portion of each of said armrests, said stopper receiving portion having opposed closed ends for engagement with said stopper in order to limit the pivotal movement of the armrests and support said backrest in said backrest and tabletop positions thereof.

5. A convertible bench as defined in claim 4, wherein said stopper receiving portion includes a curved slot defined in said end portion of each of said armrests.

6. A convertible bench as defined in claim 3, wherein said end portion of each armrest is provided in the form of a disc.

7. A convertible bench as defined in claim 1, wherein each of said armrest includes an end portion pivotally mounted between a pair of ears extending upwardly from said seat, said stopper being received in a curved slot defined in said end portion.

8. A convertible bench as defined in claim 7, wherein said stopper includes a stop pin extending transversally through said ears.

9. A convertible bench as defined in claim 7, wherein said ears extend from a forward half portion of said seat.

10. A convertible bench as defined in claim 1, wherein at least one of said seat and said backrest is provided with an advertising panel receiving portion for releasably receiving interchangeable advertising panels.

11. A convertible bench as defined in claim 1, wherein each said armrest is supported at one end only in a cantilever fashion irrespective of a position of said; backrest.

12. A convertible bench as defined in claim l, wherein said female portion forms part of said seat, and wherein said male portion forms part of each of said. armrest.

13. A convertible bench as defined in claim 12, wherein said slot extends along an arc of circle centered relative to a pivot axis of said armrests.

14. A convertible bench as defined in claim 13, wherein said stopper includes a stop pin extending in parallel to said pivot axis.

15. A convertible bench comprising a seat, a backrest, a pair of armrests extending between said seat and said backrest, each said armrest having a first end portion extending from said backrest and a second opposed end portion pivotally mounted to said seat for allowing said backrest to be swung about said armrests between a backrest position and a tabletop position, and a stopper cooperating with said second end portion of each of said armrest for supporting said backrest in a selected one of said backrest and tabletop positions thereof; wherein said stopper is received in a slot concealed within a surrounding structure.

16. A convertible bench as defined in claim 15, wherein each said armrest is supported at said second end portion only in a cantilever fashion irrespective of a position of said backrest.

17. A convertible bench as defined in claim 15, wherein said stopper includes a stop pin extending in parallel to a pivot axis of said armrests, said stop pin being received in a slot extending along an arc of circle centered relative to said pivot axis.

18. A convertible bench as defined in claim 15, wherein said second end portion of each of said armrests is received between a pair of ears projecting upwardly from the seat, said slot being defined in said second end portion.

* * * * *